US009365318B2

(12) United States Patent
Yue et al.

(10) Patent No.: US 9,365,318 B2
(45) Date of Patent: Jun. 14, 2016

(54) PACKING BOX

(71) Applicant: Shenzhen China Star Optoelectronics Technology Co., Ltd., Shenzhen, Guangdong (CN)

(72) Inventors: Liang Yue, Guangdong (CN); Yu-chun Hsiao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 14/378,447

(22) PCT Filed: Jul. 21, 2014

(86) PCT No.: PCT/CN2014/082584

§ 371 (c)(1),
(2) Date: Aug. 13, 2014

(87) PCT Pub. No.: WO2016/004643

PCT Pub. Date: Jan. 14, 2016

(65) Prior Publication Data

US 2016/0009453 A1 Jan. 14, 2016

(51) Int. Cl.
*B65D 25/10* (2006.01)

(52) U.S. Cl.
CPC ..... *B65D 25/10* (2013.01)

(58) Field of Classification Search
CPC ..... B65D 1/34; B65D 25/10; B65D 85/48; B42F 7/10
USPC ..... 206/449, 499, 453, 454, 555, 560, 564, 206/565, 722
See application file for complete search history.

(56) References Cited

U.S. PATENT DOCUMENTS

| | | | | |
|---|---|---|---|---|
| 7,731,029 | B2 * | 6/2010 | Su | B65D 85/48 206/454 |
| 2004/0108284 | A1 | 6/2004 | Huang | |
| 2013/0284638 | A1 * | 10/2013 | Hsiao | B65D 81/057 206/722 |
| 2013/0299376 | A1 * | 11/2013 | Chen | B65D 85/48 206/454 |
| 2013/0341240 | A1 * | 12/2013 | Chen | B65D 85/48 206/722 |

FOREIGN PATENT DOCUMENTS

| | | | | |
|---|---|---|---|---|
| CN | 203638329 U | * | 6/2014 | B65D 25/10 |
| SU | 1143663 A | * | 3/1985 | B65D 25/10 |
| WO | WO2006115309 A1 | | 2/2006 | |

* cited by examiner

*Primary Examiner* — Bryon Gehman
(74) *Attorney, Agent, or Firm* — Andrew C. Cheng

(57) ABSTRACT

The present invention enclosure a packing box, which is used to package a display panel; the packing box comprises a box, at least one first spacer and at least one second spacer, the step of the first spacer extends from the top to bottom of the box, the step of the second spacer extends from the bottom to top of the box, and each of steps of the first spacer is corresponded to each of steps of the second spacer, in order to crossly stack the display panel; through the above way, the present invention can increase the amount of the display panels packaged in the packing box, saving the packaging costs.

19 Claims, 4 Drawing Sheets

PACKING BOX

BACKGROUND OF THE INVENTION

1. Field of the Invention

The present invention relates to the packing technology field and in particular to a packing box used to package a display panel.

2. The Related Arts

The production of a liquid crystal display is an assembly process. Wherein the liquid crystal panel, one component of the liquid crystal display, is sealed in the liquid crystal panel packing box at first after the production, and then is transported to the respective assembly station.

The circuit board on the liquid crystal panel is composed by a plurality of different components, the heights of some components are more than thickness of the liquid crystal panel, when the liquid crystal panel is stacked in the packing box, the stacking height of one end of the circuit board is much higher than the stacking height of one end of the liquid crystal. In the prior art, the liquid crystal is usually transport by using foam box or plastic box, an EPE spacer of which the thickness is thinner is usually used between each liquid crystal panel to be interval buffer, avoiding the friction and collision between each liquid crystal panel.

However, the above technology makes the packing box not able to put in more liquid crystal panel, it causes the great waste of packing space; otherwise, the collision and friction between liquid crystal panel and the inner wall of the box can cause the premature damage of the packing box, wasting the packing costs.

SUMMARY OF THE INVENTION

The technical problem to be solved in the present invention is to provide a packing box, which can increase the amount of packed liquid crystal panel, saving the packing costs.

In order to solve the above technical problem, a technical solution adopted by the present invention is: to provide a packing box, which is used to package a plurality of substantially planar display panel, wherein the packing box comprises:

A box, having a first side face and a second side face which is laterally opposite to the first side face for laterally packing the display panels therebetween, each display panel having a first side which has a circuit board thereon and a second side which is opposite to the first side of the display panel;

At least a first spacer removeably fixed to the box, having a first wall abutting against the first side of the box, and a first inclined stepped surface in which the circuit board can be properly supported thereon when the display panel is packed within the box At least a second spacer removeably fixed to the box, having a second wall abutting against the second side of the box, and having a second inclined stepped surface arranged substantially in parallel to the first inclined stepped surface of the first spacer;

Wherein a plurality of packaging spaces is defined between the first and second inclined stepped surfaces of the first and second spacers in an offset manner in order to laterally pack one of the display panels in one of the packaging spaces, and the packaged display panels will be stacked relative each other in offset manner.

Wherein the packing box further comprises a respective engagement part provided respectively in the first spacer and the second spacer, and engagement cavities provided in the box each for engaging one of the engagement parts, wherein the engagement part can be accommodated in one of the engagement cavities in order to removably fix the first spacer and the second spacer to the box.

Wherein the engagement part of the first spacer is provided on the side where the respective first spacer abuts against the first side face, and the engagement part of the second spacer is provided on the side where the respective second spacer abuts against the second side face.

Wherein the engagement part is provided on the bottom of the first spacer and the second spacer.

Wherein the packing box respectively comprises two first spacers and second spacers, the both first spacers are respectively provided on the both ends of the first side face, the both second spacers are respectively provided on the both ends of the second side face.

Wherein the distance between the both first spacers is not shorter than the length of the circuit board of the display panel.

Wherein the width of each stepped surface of the second spacer is longer than the distance between the convex components on the circuit board and the outside of the circuit board in the display panel.

Wherein the packing box further comprises a plurality pads, and one of the pads is respectively provided between the both adjacent display panels and one of the pads is provided between the display panel and the bottom of the box.

Wherein a height of each stepped surface of the first spacer and second spacer is not lower than the sum of heights of a display panel and a pad.

In order to solve the above technical problem, the other technical solution is: to provide a packing box, which is used to package a plurality of substantially planar display panel, wherein the packing box comprises:

A box, having a first side face and a second side face which is laterally opposite to the first side face for laterally packing the display panels therebetween, each display panel having a first side which has a circuit board thereon and a second side which is opposite to the first side of the display panel;

At least a first spacer, having a first wall abutting against the first side of the box, and a first inclined stepped surface in which the circuit board can be properly supported thereon when the display panel is packed within the box;

At least a second spacer, having a second wall abutting against the second side of the box, and having a second inclined stepped surface arranged substantially in parallel to the first inclined stepped surface of the first spacer;

Wherein a plurality of packaging spaces is defined between the first and second inclined stepped surfaces of the first and second spacers in an offset manner in order to laterally pack one of the display panels in one of the packaging spaces, and the packaged display panels will be stacked relative each other in offset manner;

Wherein the first spacer and the second spacer is removably fixed to the box.

Wherein further comprises a respective engagement part provided respectively in the first spacer and the second spacer, and engagement cavities are provided in the box and each for engaging one of the engagement parts, wherein the engagement part can be accommodated in one of the engagement cavities in order to removably fix the first spacer and the second spacer to the box.

Wherein the engagement part of the first spacer is provided on a side where the respective first spacer abuts against the first side face, and the engagement part of the second spacer is provided on the side where the respective second spacer abuts against the second side face.

Wherein the engagement part is provided on the bottom of the first spacer and the second spacer.

Wherein the packing box respectively comprises two first spacers and second spacers, the both first spacers are respectively provided on the both ends of the first side face, the both second spacers are respectively provided on the both ends of the second side face.

Wherein the distance between the both first spacers is not shorter than the length of the circuit board of the display panel.

Wherein when packaging one of the display panels in the box, the width of each step of the second spacer is longer than the distance between convex components on the circuit board and an outside of the circuit board in the one of the display panels.

Wherein the packing box further comprises a plurality pads, and one of the pads is respectively provided between the both adjacent display panels and one of the pads is provided between the display panel and the bottom of the box.

Wherein a height of each stepped surface of the first spacer and second spacer is not lower than the sum of heights of a display panel and a pad.

The benefits of the present invention is: different with the situation of prior art, the present invention respectively provides the first spacer with first inclined stepped surface on the first side face and second spacer with the second inclined stepped surface arranged substantially in parallel to the first inclined stepped surface of the first spacer on the opposite second side face in the packing box such that the liquid crystal panels are sequentially stacked on the inclined stepped surfaces of the second spacer, making the liquid crystal panels of which the heights are different be properly separated and staggered in such distance, the convex components on the circuit board are also staggered sequentially, through this way, it can reduce the height of the convex components cumulatively formed when those are stacked, thereby making the packing box able to be packaged more liquid crystal panels, improving the space utilization of the packing box, reducing the packing costs.

DETAILED DESCRIPTION OF THE PREFERRED EMBODIMENTS

Figure 1:
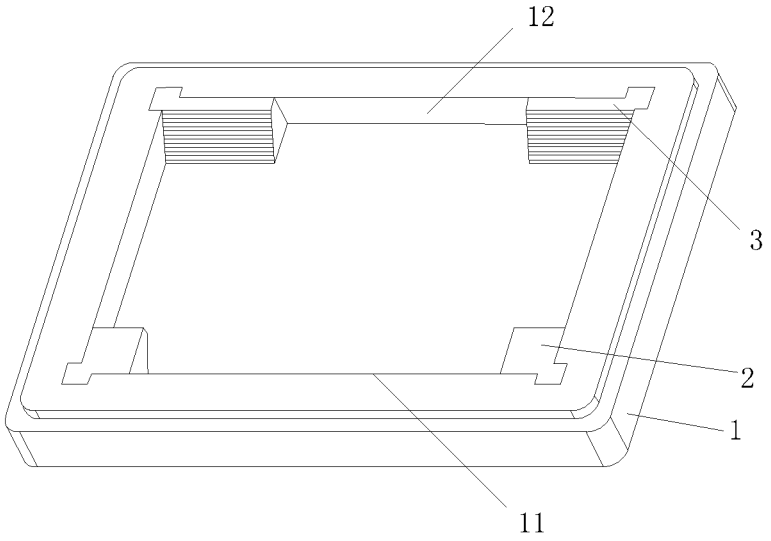
FIG. 1 is a structure diagram of an embodiment of a packing box of the present invention.
Figure 2:
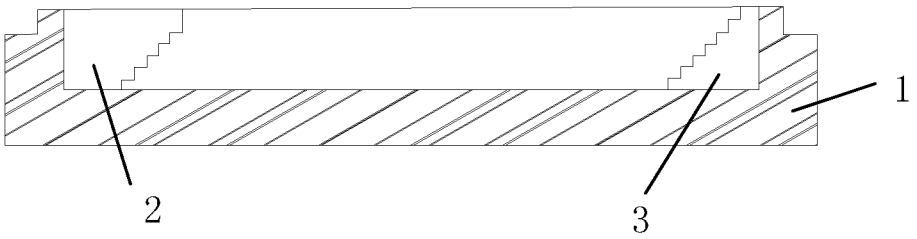
FIG. 2 is a sectional diagram of a first spacer and a second spacer in a packing box of the present invention.

Refer to FIG. 1, which is a structure diagram of an embodiment of a packing box of the present invention, a packing box in the present embodiment is used to package display panels, which comprises a box 1, which has at least one first spacer 2 and at least one second spacer 3, the box 1 has a first side face 11 and an opposite second side face 12, when packaging the display panel in the box 1, a first side of the display panel having the circuit board is disposed near the first side face 11, and a second side opposite to the first side of the display panel is disposed near the second side face 12; the first spacer 2 abuts against the first side face 11, and the circuit board of the display panel is exposed outside the first spacer in order to make the convex components on the circuit board have sufficient stacking space; the second spacer 3 abuts against the second side face 12.

Wherein as shown in FIG. 2, the step of the first spacer 2 extends from the top to bottom of the box 1; namely, the first spacer 2 is gradually narrowing on the direction of top to bottom of the box 1, making the step of the first spacer 2 towards the bottom of box 1, the step of the second spacer 3 extends from the bottom to top of the box 1; namely, the second spacer 3 is gradually widening on the direction of top to bottom of the box 1, making the step of the second spacer 3 towards the top of box 1, and each of steps of the first spacer 2 is corresponded to each of steps of the second spacer 3, in order to crossly stack the display panel; namely the amount of the steps of the first spacer 2 is equal to the second spacer 3, and a height of each stepped surface of the first spacer 2 is equal to a height of corresponded step of the second spacer 3, the height of each stepped surface of the second spacer 3 can be different, in order to fit the different height of the display panel in the packing box; preferably, the height of each stepped surface of the second spacer 3 is the same; preferably, the distance between each stepped surface corresponded by the first spacer 2 and the second spacer 3, the distance is equal to or slightly greater than the length of the panel, making the panel able to be stably packaged between the first spacer 2 and the second spacer 3 in the packing box and not move, avoiding the unnecessary damage of the display panel; preferably, the extending direction beside the both steps of the first spacer 2 and the second spacer 3 is parallel with the first side face 11 and the second side face 12. It can be readily appreciated from the forgoing that a plurality of packaging spaces is defined between the first and second inclined stepped surfaces of the first and second spacers in an offset manner in order to laterally pack one of the display panels in one of the packaging spaces, and the packaged display panels will be stacked relative each other in offset manner.

Different with the situation of prior art, the present invention respectively provides the first spacer with first inclined stepped surface on the first side face and second spacer with the second inclined stepped surface arranged substantially in parallel to the first inclined stepped surface of the first spacer on the opposite second side face in the packing box such that the liquid crystal panels are sequentially stacked on the inclined stepped surfaces of the second spacer, making the liquid crystal panels of which the heights are different be properly separated and staggered in such distance, the convex components on the circuit board are also staggered sequentially, through this way, it can reduce the height of the convex components cumulatively formed when those are stacked, thereby making the packing box able to be packaged more liquid crystal panels, improving the space utilization of the packing box, reducing the packing costs.

Figure 3:
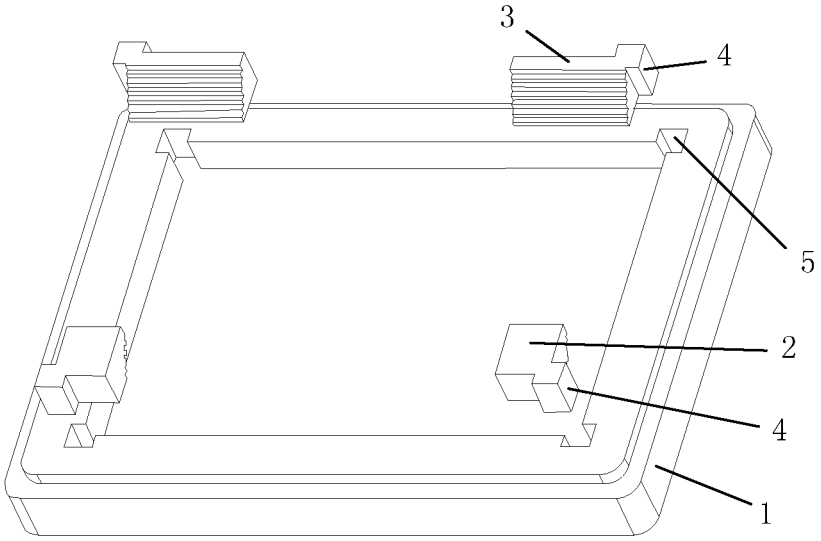
FIG. 3 is a packing diagram of an embodiment of a packing box of the present invention.
Figure 4:
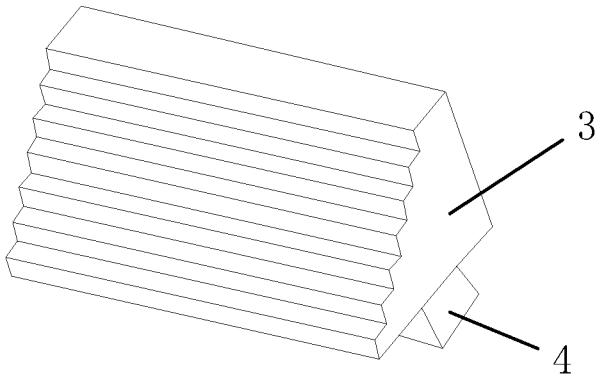
FIG. 4 is a structure diagram of an embodiment of a second spacer of the present invention.
Figure 5:
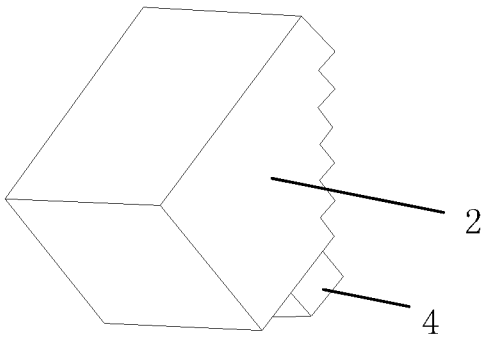
FIG. 5 is a structure diagram of an embodiment of a first spacer of the present invention.

Refer to FIG. 3, which is a packing diagram of an embodiment of a packing box of the present invention, in the other embodiment of the packing box of the present invention, the first spacer 2 and the second spacer 3 are removable fixed in the box 1; namely, the first spacer 2 and the second spacer 3 can be exchanged, since in the process of packaging and transported, the display panel and the first spacer 2 and the second spacer 3 have the unavoidable collision and friction, as time passes, the first spacer 2 and the second spacer will break, at this time, it only needs to replace the first spacer 2 and the second spacer 3, contrarily, without the replaceable first spacer 2 and second spacer 3 of the embodiment of the present invention, the box 1 will break; therefore, the present embodiment efficiently protects the box 1, improving the life of the box 1, further reducing the packaging costs; in the other embodiments of the present invention, the first spacer 2 and the second spacer 3 can also be integrally formed with the box 1.

Wherein the first spacer 2 and the second spacer 3 are respectively provided an engagement part 4, the position where the box 1 corresponds to the engagement part 4 is respectively provided a engagement cavity 5 corresponding to the engagement part 4, the engagement part 4 can be accommodated in the engagement cavity 5 in order to removably fix the first spacer 2 and the second spacer 3 in the box 1, the engagement part 4 can be a column, such as a cylinder, a prism and so on, it also can be a vertebral body.

Wherein the engagement part 4 is provided on the side where the first spacer 2 and the second spacer 3 abut against the first side face 11 or the second side face 12, it can be on the middle or on the end, when the engagement part 4 is provided on the end of the side where the first spacer 2 and the second spacer 3 abut against the first side face 11 or the second side face 12, the engagement part 4 is preferably provided on the intersection where the first side face 11 and the second side face 12 adjoin with the side face of the box 1.

Wherein the engagement part 4 also can be provided on the bottom of the first spacer 2 and the second spacer 3, as shown in FIG. 4 and FIG. 5. Otherwise, the engagement part 4 also can be provided on the side of the first spacer 2 and the second spacer 3.

Figure 6:
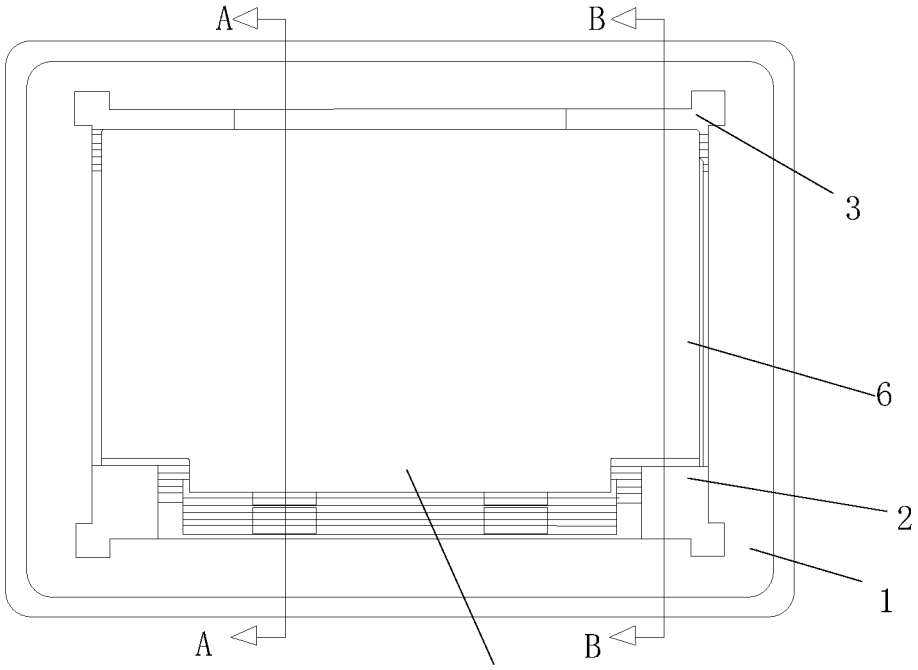
FIG. 6 is a top view of a structure diagram of a packing box packaged display panels of the present invention.
Figure 7:
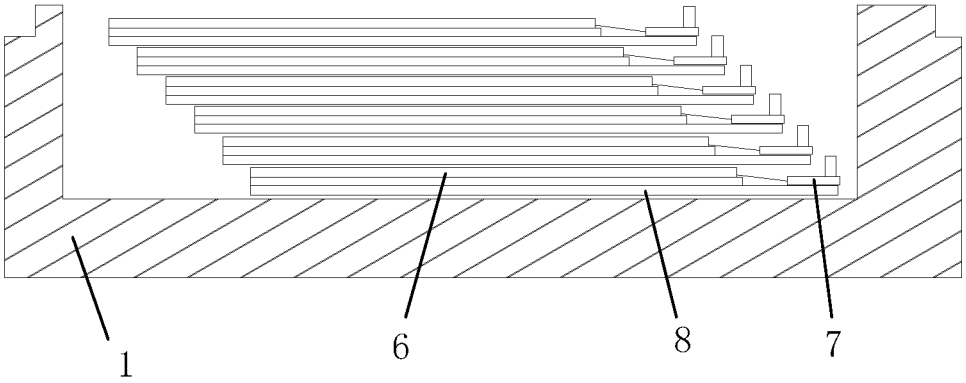
FIG. 7 is A-A line cross-sectional view in FIG. 6.
Figure 8:
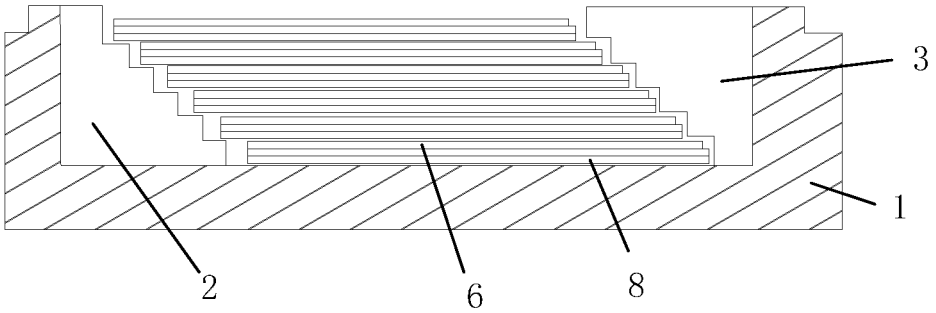
FIG. 8 is B-B line cross-sectional view in FIG. 6.

In the other embodiments of the present invention, the first spacer 2 and the second spacer 3 also can be fixed in the box 1 through the other ways such as using screw, etc.

Wherein the packing box comprises two second spacers 3, which are respectively provided on both ends of the second side face 12, providing two second spacers 3 in order to make both second spacers 3 leave a certain space, it is convenient to operate when packaging the display panel in the box 1 or taking it out.

Wherein the packing box comprises two first spacers, which are respectively provided on both ends of the first side face, making the circuit board of the display panel exposed between the two first spacers. In the other embodiments, the first spacer also can be one, when the circuit board of the display panel is provided on one side of the bottom of the display panel, the first spacer is provided on the other side of the bottom of the display panel.

Wherein as shown in FIG. 6, the distance between the two first spacers 2 is not shorter than the length of the circuit board 7 in the display panel 6, making the circuit board 7 not covered by the first spacer 2 when the display panel 6 is packaged in the packing box, it can efficiently protect the circuit board 7; meanwhile, it also can insure the lowest height of the staggered and stacked circuit board 7.

Wherein as shown in FIG. 7, the width of each stepped surface of the second spacer is longer than the distance between the convex components on the circuit board 7 and the outside of the circuit board 7 in the display panel 6, making the components on the circuit board 7 fully staggered when the display panel 6 is stacked on the steps of the second spacer, insuring the components on each circuit board 7 are not stacked on the same position, efficiently reducing the stacked height; moreover, the width of each stepped surface of the second spacer can not be too wide, it can be a little longer than the distance between the convex components on the circuit board 7 and the outside of the circuit board 7.

Wherein the packing box further comprises a plurality of pads 8, and one of the pads 8 is respectively provided between two adjacent display panels 6 and one of the pads is provided between the display panel 6 and the bottom of the box 1, the pads 8 are used to isolate the display panel 6 and the display panel 6 or the display panel 6 and the box 1, to avoid the collision and friction of the display panel 6 during packaging or transporting; preferably, the size of the pad 8 is the same as the display panel 6.

Wherein as shown in FIG. 8, a height of each stepped surface in the first spacer 2 and the second spacer 3 is not lower than the sum of the heights of a display panel 6 and a pad 8, making each stepped surface can store at least one display panel 6 and pad 8; preferably, a height of each stepped surface in the first spacer 2 and the second spacer 3 is equal to the sum of heights of a display panel 6 and a pad 8, thus when the display panel 6 and the pads 8 are provided on the step, there is no gap between the adjacent display panel 6 and the pads 8, inuring the space utilization of the box 1.

The preferred embodiments according to the present invention are mentioned above, which cannot be used to define the scope of the right of the present invention. Those modifications and variations are considered encompassed in the scope of protection defined by the claims of the present invention.

What is claimed is:

1. A packing box, which is used to package a plurality of substantially planar display panels, wherein the packing box comprises:

a box, having a first side face and a second side face which is laterally opposite to the first side face for laterally packing the display panels therebetween, each display panel having a first side which has a circuit board thereon and a second side which is opposite to the first side of the display panel;

at least a first spacer removeably fixed to the box, having a first wall abutting against the first side of the box, and a first inclined stepped surface;

at least a second spacer removeably fixed to the box, having a second wall abutting against the second side of the box, and having a second inclined stepped surface arranged substantially in parallel to the first inclined stepped surface of the first spacer;

wherein a plurality of packaging spaces is defined between the first and second inclined stepped surfaces of the first and second spacers in an offset manner in order to laterally pack one of the display panels with its circuit board properly supported in one of the packaging spaces, and the packaged display panels will be stacked relative to each other in an offset manner.

2. The packing box as claimed in claim 1, further comprises a respective engagement part provided respectively in the first spacer and the second spacer, and engagement cavities provided in the box each for engaging one of the engagement parts, wherein the engagement part can be accommodated in one of the engagement cavities in order to removably fix the first spacer and the second spacer to the box.

3. The packing box as claimed in claim 2, wherein the engagement part of the first spacer is provided on the side where the respective first spacer abuts against the first side face, and the engagement part of the second spacer is provided on the side where the respective second spacer abuts against the second side face.

4. The packing box as claimed in claim 2, wherein the engagement part of the first spacer is provided on the bottom of the first spacer and the engagement part of the second spacer is provided on the bottom of the second spacer.

5. The packing box as claimed in claim 1, wherein the packing box respectively comprises two first spacers, two second spacers, the both of the first spacers are respectively provided on an ends of the first side face, and both of the second spacers are respectively provided on an end of the second side face.

6. The packing box as claimed in claim 5, wherein when packaging one of the display panels in the box, a distance between both of the first spacers is not shorter than the length of the circuit board of the one of the display panels.

7. The packing box as claimed in claim 1, wherein when packaging one of the display panels in the box, the width of each stepped surface of the second spacer is longer than the distance between convex components on the circuit board and an outside of the circuit board in the one of the display panels.

8. The packing box as claimed in claim 1, wherein the packing box further comprises a plurality of pads, and one of the pads is provided between the adjacent display panels and one of the pads is provided between one of the display panels and a bottom of the box.

9. The packing box as claimed in claim 8, wherein a height of each stepped surface of the first spacer and second spacer is not lower than the sum of the heights of one of the display panels and the pad.

10. A packing box, which is used to package a plurality of substantially planar display panels, wherein the packing box comprises:

a box, having a first side face and a second side face which is laterally opposite to the first side face for laterally packing the display panels therebetween, each display panel having a first side which has a circuit board thereon and a second side which is opposite to the first side of the display panel;

at least a first spacer, having a first wall abutting against the first side of the box, and a first inclined stepped surface;

at least a second spacer, having a second wall abutting against the second side of the box, and having a second inclined stepped surface arranged substantially in parallel to the first inclined stepped surface of the first spacer;

wherein a plurality of packaging spaces is defined between the first and second inclined stepped surfaces of the first and second spacers in an offset manner in order to laterally pack one of the display panels with its circuit board properly supported in one of the packaging spaces, and the packaged display panels will be stacked relative to each other in an offset manner.

11. The packing box as claimed in claim 10, wherein the first spacer and the second spacer are removably fixed to the box.

12. The packing box as claimed in claim 11, further comprises a respective engagement part provided respectively in the first spacer and the second spacer, and engagement cavities provided in the box each for engaging one of the engagement parts, wherein each engagement part can be accommodated in one of the engagement cavities in order to removably fix the first spacer and the second spacer to the box.

13. The packing box as claimed in claim 12, wherein the engagement part of the first spacer is provided on a side where the respective first spacer abuts against the first side face, and the engagement part of the second spacer is provided on the side where the respective second spacer abuts against or the second side face.

14. The packing box as claimed in claim 12, wherein the engagement part of the first spacer is provided on the bottom of the first spacer and the engagement part of the second spacer is provided on the bottom of the second spacer.

15. The packing box as claimed in claim 10, wherein the packing box respectively comprises two first spacers, two second spacers, both of the first spacers are respectively provided on an end of the first side face, and both of the second spacers are respectively provided on an end of the second side face.

16. The packing box as claimed in claim 15, wherein when packaging one of the display panels in the box, a distance between both of the first spacers is not shorter than the length of the circuit board of the one of the display panels.

17. The packing box as claimed in claim 10, wherein when packaging one of the display panels in the box, the width of each stepped surface of the second spacer is longer than the distance between convex components on the circuit board and an outside of the circuit board in the one of the display panels.

18. The packing box as claimed in claim 10, wherein the packing box further comprises a plurality of pads, and one of the pads is provided between the adjacent display panels and one of the pads is provided between the one of the display panels and a bottom of the box.

19. The packing box as claimed in claim 18, wherein a height of each stepped surface of the first spacer and second spacer is not lower than the sum of heights of one display panel and one pad.

* * * * *